United States Patent [19]

Chapman

[11] 4,240,919

[45] Dec. 23, 1980

[54] THIXOTROPIC ABRASIVE LIQUID SCOURING COMPOSITION

[75] Inventor: Francis E. Chapman, Racine, Wis.

[73] Assignee: S. C. Johnson & Son, Inc., Racine, Wis.

[21] Appl. No.: 964,318

[22] Filed: Nov. 29, 1978

[51] Int. Cl.[3] ..... C11D 3/395; C11D 3/14; C11D 3/37; C11D 17/08

[52] U.S. Cl. ..... 252/95; 252/99; 252/103; 252/133; 252/140; 252/155; 252/173; 252/174.23; 252/174.25; 252/160; 252/311; 252/313 R; 252/313 S; 252/DIG. 2; 252/DIG. 14

[58] Field of Search ..... 252/95, 96, 97, 99, 252/103, 113, 116, 120, 123, 128, 129, 131, 140, 133, 155, 173, 174.25, DIG. 14, 174.23, 160, 311, 313 R, 313 S

[56] References Cited

U.S. PATENT DOCUMENTS

| | | | |
|---|---|---|---|
| 3,179,597 | 4/1965 | Mankowich | 252/125 |
| 3,560,389 | 2/1971 | Hunting | 252/95 |
| 3,759,846 | 9/1973 | Robb | 252/527 |
| 3,956,158 | 5/1973 | Donaldson | 252/102 |
| 3,956,162 | 5/1976 | Lautenberger | 252/162 |
| 3,976,588 | 8/1976 | McLaughlin | 252/117 |
| 3,985,669 | 10/1976 | Hartman | 252/99 |
| 4,005,027 | 1/1977 | Hartman | 252/95 |
| 4,006,091 | 2/1977 | Lindblom | 252/90 |
| 4,051,056 | 9/1977 | Hartman | 252/99 |
| 4,071,463 | 1/1978 | Steinhauer | 252/103 |
| 4,129,527 | 12/1978 | Clark | 252/547 |
| 4,154,694 | 5/1979 | Donaldson | 252/98 |

FOREIGN PATENT DOCUMENTS

| | | |
|---|---|---|
| 249140 | 4/1963 | Australia . |
| 2223444 | 10/1974 | France . |
| 1504013 | 3/1978 | United Kingdom . |

*Primary Examiner*—Dennis L. Albrecht

[57] ABSTRACT

An improved liquid abrasive scouring composition which has substantially no syneresis is prepared by mixing water, an abrasive and a multivalent stearate in specified ratios. The composition may include a number of optional ingredients to further enhance the cleaning ability of the liquid abrasive scouring composition, such as non-multivalent stearate surfactant, bleach, bodying agent, electrolyte and absorptive agent.

15 Claims, No Drawings

THIXOTROPIC ABRASIVE LIQUID SCOURING COMPOSITION

TECHNICAL FIELD

This invention relates to liquid abrasive scouring cleaning compositions and particularly those which are used in the home.

Liquid abrasive scouring compositions contain abrasive particles which settle out of the product during shipping and storage before the product reaches the ultimate consumer. Numerous attempts have been made to achieve both suitable suspension of the abrasive particles in the liquid compositions to prevent large scale settling and packing at the bottom of the container, and at the same time ease of dispensing the thickened product from a container.

BACKGROUND OF INVENTION

Australian patent specification No. 249,140 describes a liquid abrasive scouring cleanser composition including finely divided abrasives and water soluble sodium or potassium soaps, such as those derived from tallow, palm oil or coconut oil. There is no disclosure of substantially water-insoluble polyvalent stearate soaps nor is there any disclosure of the effect of these polyvalent metal soaps on the thixotropic properties of the composition.

U.S. Pat. No. 3,985,668 describes a stable, false body liquid abrasive scouring cleanser composition utilizing, as a suspending agent, a light particular filler material having a diameter ranging between 1 and 250 microns which aids in maintaining the suspension of the particular abrasive material. A wide range of surfactants are disclosed. However, no water-insoluble polyvalent metal soaps are described.

U.S. Pat. No. 4,005,027 describes the use of various colloid-forming clays such as attapulgites, smectities and mixtures of these materials. Again, there is no disclosure that water-insoluble polyvalent metal soaps are effective to improve stability of the system.

DISCLOSURE OF INVENTION

The present invention is directed to a stable, thixotropic liquid abrasive cleaning composition comprising:

(a) From 1 to 60% by weight of a water-insoluble particulate abrasive;
(b) From 0 to 10% by weight of a bleach;
(c) From 0 to 20% by weight of a non-multivalent stearate surfactant;
(d) From 0 to 10% by weight of an electrolyte;
(e) From 0 to 5% by weight of a bodying agent selected from colloidal silica, attapulgites, smectites, diatomaceous earth, and mixtures thereof;
(f) From 0 to 25% by weight of a light density filler and mixtures thereof;
(g) From 0.05 to 10% by weight of a multivalent stearate soap selected from the group consisting of aluminum monostearate, aluminum distearate, aluminum tristearate, calcium stearate, zinc stearate, magnesium stearate, barium stearate, and mixtures thereof; and
(h) The balance water, with the proviso that the composition contain at least some electrolyte, or some non-multivalent stearate surfactant.

The instant composition is substantially non-separating upon standing for extended periods of time and alleviates the problem of packing the abrasive in the bottom of the container upon storage. Furthermore, the thixotropic system of the present invention is relatively simple to prepare and reduces the syneresis or separation of water from compositions including those which include false body agents, such as fillers and clays.

Furthermore, the above composition is stable with respect to decomposition and separation in the presence of bleaches and, particularly, chlorine-containing bleaches.

BEST MODE FOR CARRYING OUT THE INVENTION

The aqueous liquid abrasive cleaning composition of the present invention contains three essential components: the aqueous liquid phase comprising water; a water-insoluble abrasive; and a polyvalent metal stearate soap. In addition to these three essential components, the composition must contain a small amount of at least one of the following classes of materials, non-multivalent stearate surfactant or electrolyte. Further, the composition may contain optional components such as bleaches, bodying agent, light density filters, dyes, pigments, perfumes and preservatives which can be incorporated into the composition of the present invention.

The compositions of the present invention exhibit the characteristics of non-Newtonian fluids. Because the amount of shear exerted upon the composition during dispensing through a limited sized orifice is limited, it is not necessary to determine which forms of non-Newtonian flow these materials exhibit, i.e., pseudoplastic behavior, thixotropic behavior or Bingham plastic behavior. The compositions of the present invention are relatively thick and immobile at rest. However, if shear force is applied to the composition either by shaking or by squeezing the composition through a restricted orifice, the viscosity of the composition decreases so as to allow the same to flow readily and be dispensed. As the amount of shear which is applied to these compositions is far below the breakdown point, the exact determination of the non-Newtonian fluid flow characteristics need not be made. As the flow properties of the compositions of the present invention are generally similar to those exhibited by thixotropic liquids, they will hereafter be described as "thixotrophic".

The composition of the present invention is an aqueous composition and, as such, the prime component of the composition is water. Although it is not necessary for the successful preparation of compositions of the present invention, it is preferred that deionized or softened water be utilized as this minimizes the addition of stray metal ions which could have an unstabilizing effect on the composition. This is especially true if a bleach is incorporated into the composition as small amounts of certain metal ions such as iron and copper effectively catalyze the decomposition of bleaches in an aqueous system.

The amount of water in the composition is not particularly critical and, in general, comprises the balance of the composition to make 100% by weight. Generally, this will be in amounts ranging from about 25 to 85% by weight water and preferably from about 40 to about 65% by weight water.

The abrasive materials which are suitable for use in the composition of the present invention are relatively heavy water-insoluble particulate materials which are capable of being suspended throughout the thixotropic liquid composition of the present invention. Generally, these abrasive materials have particle sizes in the range of from 1 to 250 microns, although it is possible that a small percentage of the abrasive will have a particle size of larger than 250 microns.

Suitable abrasives which can be utilized in the composition of the present invention include titanium dioxide, silica sand, calcium carbonate, calcium phosphate, zirconium silicate, diatomaceous earth, quartz, pumice, pumicite, whiting, perlite, tripoli, melamine, urea formaldehyde resins, ground rigid polymeric materials, such as polyurethane foam, feldspar, vermiculite, water absorbant soft abrasives, such as calcium silicate and aluminum silicate. Furthermore, mixtures of these abrasives can be utilized in the compositions so as to provide a balanced composition having both hard and soft abrasives. The preferred abrasives for use in the composition of the present invention are calcium carbonate, aluminum oxide, silica, calcium silicate and mixtures thereof. The water-insoluble abrasive material must be present in the amount of from 1 to 60% by weight and preferably from 10 to 50% by weight and most preferably from about 25 to 40% by weight.

In those compositions which do not contain a bodying agent and particularly when the composition does not include a smectite or attapulgite clay, it is preferred that at least 5% by weight of the composition and preferably from 5 to 20% by weight of an absorbant abrasive, such as calcium silicate, aluminum silicate or mixtures thereof. Generally, these absorptive abrasives are used in combination with a primary abrasive, such as calcium carbonate or silica.

The primary agents in the composition of the present invention which provide the same with their novel and unique thixotropic characteristics are the multivalent metal stearate soaps. These metal stearate soaps are water-insoluble materials which provide a gel or colloidal flow characteristic to the compositions of the present invention. Suitable multivalent metal stearate soaps include aluminum monostearate, aluminum distearate, aluminum tristearate, calcium stearate, zinc stearate, magnesium stearate and barrium stearate and mixtures thereof. The preferred stearate soaps for use in the composition of the present invention are magnesium stearate and the aluminum stearates and particularly aluminum monostearate soap. These multivalent metal stearate soaps must be present in the composition of the present invention in an amount of from 0.05 to 10% by weight and preferably from 0.1 to 2% by weight and optimally from 0.2 to 0.5% by weight.

To aid in the cleaning of the hard surface by the abrasive, a non-multivalent stearate surfactant material may be included in the composition of the present invention. By the terms "surfactant" or "non-multivalent stearate surfactant" in this specification and the appended claims is any surfactant that is not a multi-valent stearate soap, as described in this specification. Substantially any surfactant materials which are compatible with the other components in the composition of the present invention can be utilized. These include water-soluble anionic, nonionic, amphoteric, cationic and zwiterionic surfactants. It should be noted that this term surfactant does not include water-insoluble multivalent metal stearate soaps which are used as the bodying agents in the compositions of the present invention.

In addition, as the preferred compositions of the present invention include a bleach and particularly a chlorine bleach, it is preferred that the surfactant which is utilized in the composition of the present invention be stable in the presence of such bleach and not contribute to the decomposition both of the surfactant and the bleach. Therefore, it is preferred that these surfactants not include any functional groups such as hydroxy groups, aromatic rings, ether linkages, unsaturated groups, etc. which are susceptible to oxidation by bleaching groups and compositions.

Bleach-stable surfactants which are especially resistant to hypochlorite oxidation fall into two main groups. One such class of bleach-stable surfactants are the water-soluble alkyl sulfates containing from about 8 to 18 carbon atoms in the alkyl group. Alkyl sulfates are the water-soluble salts of sulfated fatty alcohols. They are produced from natural or synthetic fatty alcohols containing from about 8 to 18 carbon atoms. Natural fatty alcohols include those produced by reducing the glycerides of naturally occurring fats and oils. Fatty alcohols can also be produced synthetically, for example, by the Oxo process. Examples of suitable alcohols which can be employed in alkyl sulfate manufacture include decyl, lauryl, myristyl, palmityl and stearyl alcohols and the mixtures of fatty alcohols derived by reducing the glycerides of tallow and coconut oil.

Specific examples of alkyl sulfate salts which can be employed in the instant detergent compositions include sodium lauryl alkyl sulfate, sodium stearyl alkyl sulfate, sodium palmityl alkyl sulfate, sodium decyl sulfate, sodium myristyl alkyl sulfate, potassium lauryl alkyl sulfate, potassium stearyl alkyl sulfate, potassium decyl sulfate, potassium palmityl alkyl sulfate, potassium myristyl alkyl sulfate, sodium dodecyl sulfate, potassium dodecyl sulfate, potassium tallow alkyl sulfate, sodium tallow alkyl sulfate, sodium coconut alkyl sulfate, potassium coconut alkyl sulfate and mixtures of these surfactants. Highly preferred alkyl sulfates are sodium coconut alkyl sulfate, potassium coconut alkyl sulfate, potassium lauryl alkyl sulfate and sodium lauryl alkyl sulfate.

A second class of bleach-stable surfactant materials highly preferred for use in the compositions of the instant invention which contain hypochlorite bleach are the water-soluble betaine surfactants. These materials have the general formula:

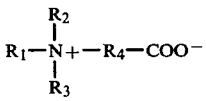

wherein $R_1$ is an alkyl group containing from about 8 to 18 carbon atoms; $R_2$ and $R_3$ are each lower alkyl groups containing from about 1 to 4 carbon atoms; and $R_4$ is an alkylene group selected from the group consisting of methylene, propylene, butylene and pentylene. (Propionate betaines decompose in aqueous solution and are hence not suitable for use in the instant compositions.)

Examples of suitable betaine compounds of this type include dodecyldimethylammonium acetate, tetradecyldimethylammonium acetate, hexadecyldimethylammonium acetate, alkyldimethylammonium acetate wherein the alkyl group averages about 14.8 carbon atoms in length, dodecyldimethylammonium butanoate, tetradecyldimethylammonium butanoate, hexadecyldimethylammonium butanoate, dedecyldimethylammonium hexanoate, hexadecyldimethylammonium hexanoate, tetradecyldiethylammonium pentanoate and tetradecyldipropylammonium pentanoate. Especially preferred betaine surfactants include dodecyldimethylammonium acetate, dodecyldimethylammonium hexanoate, hexadecyldimethylammonium acetate and hexadecyldimethylammonium hexanoate.

Preferred surfactants for use in the composition of the present invention include sodium lauryl sulfate combined with sodium xylene sulfonate. The surfactant should be present in an amount of from 0 to 20% by weight and preferably from 0.1 to 15% by weight, and optimally from 2 to 15% by weight.

The composition of the present invention also includes from 0 to 10% by weight of an electrolyte composition. These materials are utilized in the instant composition to maintain the pH within the range of from 10.5 to 14 so as to aid in stabilizing any bleach, if present. Suitable materials for use as the electrolyte or buffering agent must be bleach-stable and can include various alkali metal and alkine earth salts such as carbonates, bicarbonates, sesquicarbonates, silicates, pyrophosphates, phosphates, tetraborates and mixtures thereof. As examples of these materials, the following may be included: sodium carbonate, sodium bicarbonate, sodium sesquicarbonate, sodium silicate, tetrapotassium pyrophosphate, trisodium phosphate, anhydrous sodium tetraborate, sodium tetraborate pentahydrate and sodium tetraborate decahydrate. The preferred materials for use in the composition of the present invention are sodium carbonate, sodium metasilicate or mixtures of sodium carbonate with sodium metasilicate. The electrolyte should be present in an amount of from 0 to 10% by weight and preferably from about 0.1 to 6% by weight, and optimally from 3 to 6% by weight.

As noted above, the composition must include at least some surfactant or some electrolyte or both surfactant and electrolyte. At least one of these materials must be present even in very small amounts, i.e., 0.1% by weight, to aid in dispersing the multivalent stearate soap.

The composition of the present invention may also include a bodying agent which provides some of the viscosity and thickening in the composition. These bodying agents include colloidal fumed silica, calcium diatomate, attapulgites, smectites, and mixtures thereof. These materials are used to give a non-Newtonian character to the system. These bodying agents are present in the composition in an amount of from 0 to 5% by weight and preferably from 1 to 5% by weight.

A further optional component of the system is a light density filler material. Suitable fillers include various powdered polymeric and plastic materials, such as powdered polymers, i.e., polyethylene, polypropylene, polystyrene, polyester resin, phenolic resin, polysulfide, as well as glass microspheres and hollow glass microballons. These materials aid the polyvalent metal stearate in reducing the syneresis or free liquid which forms on standing. The light density filler may be present in an amount of from 0 to about 25% by weight, and preferably in an amount of from 5 to 20% by weight.

As the primary and preferred optional ingredient for use in the composition of the present invention is a bleach, these bleaching agents can be any suitable bleaching agent which yields active chlorine or oxygen in an aqueous system. Most preferred bleaching systems are those which yield a hypochlorite species in aqueous solution. The hypochlorite ion is a very strong oxidizing agent and yields materials which are considered powerful bleaching agents.

Suitable bleaching agents which yield a hypochlorite species in aqueous systems are the alkali metal and alkaline earth hypochlorites, hypochlorite addition products, chloramines, chlorimines, chloramids, chlorimids. Specific examples include sodium hypochlorite, potassium hypochlorite, monobasic calcium hypochlorite, dibasic magnesium hypochlorite, chlorinated disodium phosphate dodecahydrate, potassium dichloroisocyanurate, sodium dichloroisocyanurate, sodium dichloroisocyanuruate dihydrate, trichlorocyanuric acid, 1,3-dichloro-5,5-dimethylhydantoin, N-chlorosulfamide, Chloramine T, Dichloramine T, Chloramine B and Dichloramine B. Preferred bleaching agents for use in the compositions of the present invention are sodium hypochlorite and monobasic calcium hypochlorite when utilized in combination with sodium silicate which forms sodium hypochlorite in situ. If present, the bleaching agents should be present in an amount of from 0.1 to 10% by weight and preferably from about 0.5 to 3% by weight.

The composition of the present invention also may include additional builder compositions, stabilizers, coloring agents and perfumes. These materials must be stable to chlorine bleaches if chlorine bleach and bleaching agents are present in the composition of the present invention. In general, these optional materials should not present in the total composition in an amount of more than 5% by weight and are generally dissolved in or emulsified in the composition.

The composition of the present invention is prepared by first dissolving a small percentage of the electrolyte, if present, in water, the polyvalent stearate soap added using high shear so as to wet the same and disperse the soap. The low density filler, if used, is added at this point. The other components of the formulation, including the chlorine bleach, are added in any sequence with mixing. This composition prepared by this composition has an apparent high viscosity. However, upon shaking or squeezing through a small orifice, the product thins substantially so that the same may be easily dispensed.

The composition of the present invention will now be illustrated by way of the following examples wherein all parts and percentages are by weight and all temperatures are in degrees centigrade.

EXAMPLE 1

| | |
|---|---|
| 30% sodium lauryl sulfate (Onyx Maprofix LCP) | 12.0% |
| 325 mesh ground white sand | 30.0 |
| benonite (Whittaker, Clark & Daniels B49) | 4.7 |
| potassium stearate | 2.2 |
| magnesium stearate U.S.P. | 0.2 |
| dye, perfume and preservative | q.s. |
| water | to 100% |

The bentonite is added to water at high sheer agitation using a Premier Dispersator. After mixing for maximum thixotrophy, the potassium stearate and magnesium stearate are added. The sodium lauryl sulfate is added and the mixture is agitated to uniformity. The abrasive, dye, perfume and preservative are then added.

The composition was placed in a 16 fluid oz. container and allowed to set undisturbed for 3 months, after which time the amount of syneresis, or free liquid, is measured. The composition of Example 1 had less than 1% free liquid, too little to measure. The composition is an effective liquid abrasive composition.

COMPARATIVE EXAMPLE 1

| | |
|---|---|
| 30% active sodium lauryl sulfate (Onyx Maprofix LCP) | 13.0% |
| 325 mesh ground white sand | 30.0 |
| bentonite (Whittaker, Clark & Daniels B49) | 4.5 |
| potassium stearate | 2.1 |
| dye, perfume and preservative | q.s. |
| water | to 100% |

The above composition was prepared using the procedure of Example 1. When tested for syneresis, as in Example 1, the composition showed a free liquid of 13% by volume.

EXAMPLE 2

| | |
|---|---|
| Mg stearate, U.S.P. | 0.15% |
| sodium carbonate | 1.90 |
| tetrapotassium pyrophosphate | 6.60 |
| calcium hypochlorite, 65% active | 1.40 |
| amine oxide, surfactant, 30% active Ammonyx LO (lauryl dimethyl amine oxide) | 5.85 |
| tripotassium phosphate | 1.80 |
| aluminum oxide | 1.00 |
| veegum H.S. - Vanderbilt (Montmorillonite) | 3.98 |
| deionized water, coloring agent and perfume | 77.32 |
| | 100.00% |

The above composition was prepared using the procedure of Example 1, except that the calcium hypochlorite and sodium carbonate are added before the magnesium stearate and allowed to react to form sodium hypochlorite in situ. The phosphate is also added just before the stearate. This composition showed substantially no syneresis on standing. Further accelerated stability testing indicated the chlorine content would not reduce to 0.13% until after 18 months.

EXAMPLE 3

| | |
|---|---|
| aluminum monostearate, U.S.P. | 0.3% |
| sodium carbonate | 5.7 |
| sodium metasilicate | 1.0 |
| calcium hypochlorite, 65% active | 1.2 |
| ARCO polyethylene powder P.E. 750 | 7.7 |
| sodium lauryl sulfate | 1.0 |
| sodium xylene sulfonate | 1.0 |
| Feldspar | 25.9 |
| calcium silicate, Johns Manville, Microcel E | 2.1 |
| deionized water, fragrance, coloring agent | 54.1 |
| | 100.0% |

This composition was prepared by adding the water to a mixture of sodium carbonate, sodium metasilicate and calcium hypochlorite. The aluminum monostearate and polyethylene is added with agitation followed by the remaining components.

When tested for syneresis, this composition showed less than 1% free liquid after 3 months and required over 18 months to reduce the hypochlorite content to 0.13%.

EXAMPLE 4

| | |
|---|---|
| water | 70.63% |
| veegum | 3.25 |
| sodium carbonate | 1.87 |
| calcium hypochlorite | 1.40 |
| 55% solution of tripotassium phosphate | 3.50 |
| tetra potassium pyrophosphate | 6.50 |
| alumina, Alcoa A3 (325 mesh) | 1.00 |
| magnesium stearate U.S.P. | 0.10 |
| amine oxide, Onyx Ammonyx LO | 5.16 |
| sodium xylene sulfate (Witco Chemical Co.) | 6.56 |
| pine essence | 0.03 |
| | 100.00% |
| pH 11.7 | |

The composition is prepared using the procedure of Example 2. Brookfield viscosity is 190 centipoise, #3 spindle, #12 rpm, sixty seconds after standing overnight. Even at this viscosity, the system is perfectly dispersed and had no measurable syneresis after 30 days.

EXAMPLE 5

| | |
|---|---|
| veegum HS, Vanderbilt montmorillonite | 3.75% |
| sodium carbonate | 5.70 |
| sodium metasilicate | 1.00 |
| calcium hypochlorite, 65% active Olin Chemical | 1.40 |
| amorphous silia, Illinois Minerals Insil A25 | 10.00 |
| magnesium stearate U.S.P.-Witco | 0.21 |
| amine oxide surfactant, Onyx Ammonyx LO | 2.10 |
| sodium xylene sulfonate, 40% active Witco Chemical Co. | 2.60 |
| water and pine fragrance | to 100% |
| pH 11.8; Viscosity, Brookfield, #3 spindle, 12 rpm, sixty minutes; 5400 cps. | |

Process: 87% of water at 60° C. is used to disperse veegum with a dispersator. After full body is obtained, add balance of water at room temperature. In sequence, stir in silica, sodium carbonate, bleach and sodium metasilicate. Predisperse the magnesium stearate in the surfactant blend and add to batch, then pine perfume.

After standing at room temperature for one month in a tall form 10 fluid oz. plastic container, there is no syneresis.

This formula, when stored at 43° C., requires 11 weeks to reach a chlorine content of 0.13% wt./wt. This would correspond to two years storage at room temperature.

EXAMPLE 6

| | |
|---|---|
| aluminum monostearate U.S.P.-Witco | 0.3% |
| sodium carbonate | 5.7 |
| calcium hypochlorite | 1.2 |
| sodium metasilicate | 1.0 |
| feldspar | 25.9 |
| calcium silicate, Microcel E Johns Manville | 2.1 |
| sodium lauryl sulfate | 1.0 |
| sodium xylene sulfonate | 2.5 |
| ultramarine blue | 0.07 |
| polyethylene powder, ARCO P.E. 750 | 7.70 |
| pine fragrance | 0.03 |
| deionized water | to 100% |

Process: To the water stir in with dispersator calcium hypochlorite and sodium carbonate. Sift in aluminum monostearate and polyethylene. In sequence, stir in calcium silicate and feldspar and blue. With moderate speed of mixing, add in sequence sodium xylene sulfonate, sodium lauryl sulfate and pine fragrance, lastly sodium metasilicate. Measure viscosity at once.

pH 12; Brookfield viscosity, #3 spindle, 12 rpm., 30 seconds

Freshly made 1600 cps.

Overnight 4400 cps.

The hypochlorite will reach 0.13% after 19 weeks at 43.35° C. This corresponds to well over two years shelf stability.

EXAMPLE 7

| | |
|---|---|
| aluminum distearate (Witco #16) | 2.9% |
| sodium metasilicate | 0.3 |
| calcium hypochlorite (65%) | 1.2 |
| calcium carbonate | 40.0 |
| sodium lauryl sulfate (30%) | 3.8 |
| sodium hydroxide (50%) | 0.7 |
| fumed silica (Cab-O-Sil M5) | 1.5 |
| tap water | 49.6 |
| | 100.0% |

The sodium metasilicate is added to the water which has been heated to 60° C. The aluminum distearate is stirred into the above mixture. The resulting mixture is cooled to 21° C. and the calcium carbonate, calcium hypochlorite, sodium hydroxide and sodium lauryl sulfate are added. The mixture is allowed to stand overnight, and the fumed silica is dispersed into the composition.

This composition shows minimal free liquid on standing.

EXAMPLE 8

| | |
|---|---|
| aluminum distearate (Witco #30) | 0.375% |
| sodium carbonate | 3.750 |
| sodium metasilicate | 0.600 |
| calcium hypochlorite (65%) | 1.500 |
| calcium silicate | 7.000 |
| calcium carbonate | 33.000 |
| sodium lauryl sulfate (30%) | 3.300 |
| sodium xylene sulfonate (40%) | 3.300 |
| water | 47.175 |
| | 100.000% |

The above components are processed as in Example 7. The composition shows substantially no free liquid on standing.

EXAMPLE 9

| | |
|---|---|
| calcium stearate | 0.73% |
| sodium carbonate | 3.43 |
| sodium metasilicate | 0.73 |
| calcium carbonate | 33.06 |
| calcium hypochlorite (65%) | 1.47 |
| sodium xylene sulfonate (40%) | 3.35 |
| sodium lauryl sulfate (30%) | 3.35 |
| calcium silicate ($CaO \cdot SiO_2$ calcined) Microcel E | 6.12 |
| water | 47.76 |
| | 100.00% |

The above components are processed using the procedure of Example 7. There is substantially no free liquid on standing.

EXAMPLE 10

| | |
|---|---|
| aluminum tristearate (Witco #132) | 0.38% |
| sodium carbonate | 3.75 |
| calcium hypochlorite (65%) | 1.50 |
| sodium metasilicate | 0.62 |
| calcium carbonate | 33.88 |
| Microcel E | 6.12 |
| sodium lauryl sulfate (30%) | 3.25 |
| water | 50.50 |
| | 100.00% |

The above components are processed using the procedure of Example 7. There is substantially no free liquid on standing.

EXAMPLE 11

| | |
|---|---|
| zinc stearate U.S.P. | 0.50% |
| sodium carbonate | 3.38 |
| sodium metasilicate | 0.50 |
| calcium hypochlorite (65%) | 1.29 |
| calcium carbonate (Calcium Carbonate Co. Q3) | 32.34 |
| sodium lauryl sulfate (30%) | 3.18 |
| sodium xylene sulfonate (40%) | 3.18 |
| deionized water | 49.16 |
| Microcel E | 6.47 |
| | 100.00% |

The above components are processed using the procedure of Example 7. The composition is quite stable and has little free liquid on standing.

EXAMPLE 12

| | |
|---|---|
| calcium silicate, Microcel E | 12.5% |
| calcium stearate | 12.5 |
| sodium xylene sulfonate (40%) | 5.0 |
| water | 70.0 |
| | 100.0% |

The above composition was prepared by dispersing the surfactant in water at 43° C. The calcium stearate is then added and the composition is cooled to 21° C. The calcium silicate is then added. The composition has a pH of 8.6 and a Brookfield viscosity of 2000 cps. The composition has little free liquid on standing.

EXAMPLE 13

| | |
|---|---|
| calcium silicate, Microcel E | 7.5% |
| expanded Perlite | 3.1 |
| calcium stearate | 11.1 |
| sodium carbonate | 4.9 |
| water | 73.4 |
| | 100.0% |

The above composition has a pH of 10.5 and a viscosity of 3500 cps. The composition was prepared using the procedure of Example 7. There was substantially no free liquid on standing.

I claim:

1. A stable, liquid abrasive cleaning composition comprising:

(a) from about 1 to about 60% by weight of a water insoluble particulate abrasive selected from the group consisting of titanium dioxide, silica sand, calcium carbonate, calcium phosphate, zirconium silicate, diatomaceous earth, quartz, pumice, pumicite, whiting, perlite, tripoli, melamine, urea formaldehyde resins, ground rigid polyurethane foam, feldspar, vermiculite, calcium silicate, aluminum silicate and mixtures thereof;

(b) from 0.1 to about 10% by weight of bleach;

(c) from 0 to about 20% by weight of a non-multivalent stearate surfactant;

(d) from 0 to about 10% by weight of a bleach stable electrolyte capable of maintaining the pH of the composition within the range of 10.5 to 14;

(e) from 5 to about 20% by weight of a light density filler selected from powdered polyethylene, powdered polypropylene, powdered polystyrene, powdered polyester resin, powdered phenolic resin, powdered polysulfide, glass microspheres and hollow glass microballons;

(g) from about 0.05 to about 10% by weight of a multivalent stearate soap selected from the group consisting of aluminum monostearate, aluminum distearate, aluminum tristearate, calcium stearate, zinc stearate, magnesium stearate, barium stearate and mixtures thereof; and (g) water, with the proviso that the composition contain at least some electrolyte or some non-multivalent stearate surfactant and that the composition is free of bodying agents selected from colloidal silica, atapulgites, smectites, diatomaceous earth and mixtures thereof.

2. The composition of claim 1 wherein the abrasive is present in an amount of from 10 to 50% by weight.

3. The composition of claim 2 wherein the abrasive is present in an amount of from 25 to 40% by weight.

4. The composition of claim 1 wherein the abrasive has a particle size within the range of from about 1 to about 250 microns.

5. The composition of claim 1 wherein the non-multivalent stearate surfactant is present in the range of from 0.1 to 15% by weight.

6. The composition of claim 1 wherein the electrolyte is present in an amount of from 0.1 to 6% by weight.

7. The composition of claim 1 wherein the bodying agent is present in an amount of from 1 to 5% by weight.

8. The composition of claim 1 wherein the multivalent metal stearate soap is present in an amount of from 0.1 to 2% by weight.

9. The composition of claim 8 wherein the multivalent stearate stearate soap is present in an amount of from 0.2 to 0.5% by weight.

10. The composition of claim 1 wherein the multivalent stearate is selected from the group consisting of aluminum monostearate, aluminum distearate, aluminum tristearate, magnesium stearate and mixtures thereof.

11. The composition of claim 1 wherein the multivalent stearate soap is selected from the group consisting of aluminum monostearate, magnesium stearate and mixtures thereof.

12. The composition of claim 1 wherein the multivalent stearate soap is aluminum monostearate.

13. The composition of claim 1 wherein the multivalent stearate soap is magnesium stearate.

14. The composition of claim 1 wherein the bleaching agent is present in an amount of from 0.5 to 3% by weight.

15. The composition of claim 1 wherein the bleaching agent is selected from the group consisting of sodium hypochlorite, monobasic calcium hypochlorite and mixtures thereof.

* * * * *